US005456619A

United States Patent [19]

Belopolsky et al.

[11] Patent Number: 5,456,619

[45] Date of Patent: Oct. 10, 1995

[54] FILTERED MODULAR JACK ASSEMBLY AND METHOD OF USE

[75] Inventors: Yakov Belopolsky, Harrisburg; William A. Northey, Etters, both of Pa.; Jenn Tsao, Yungmei Town, Taiwan

[73] Assignee: Berg Technology, Inc., Reno, Nev.

[21] Appl. No.: 299,151

[22] Filed: Aug. 31, 1994

[51] Int. Cl.[6] ..... H01R 13/66

[52] U.S. Cl. ..... 439/620; 439/676

[58] Field of Search ..... 439/620, 676

[56] References Cited

U.S. PATENT DOCUMENTS

| | | | |
|---|---|---|---|
| 4,202,593 | 5/1980 | Abernethy et al. . | |
| 4,401,355 | 8/1983 | Young . | |
| 4,457,570 | 7/1984 | Bogese, II . | |
| 4,618,207 | 10/1986 | Silbernagel . | |
| 4,698,025 | 10/1987 | Silbernagel et al. | 439/79 |
| 4,699,595 | 10/1987 | Nakazawa et al. | 439/676 |
| 4,703,991 | 11/1987 | Philippson | 439/676 |
| 4,717,217 | 1/1988 | Bogese, II | 493/83 |
| 4,734,043 | 3/1988 | Emert et al. | 439/65 |
| 4,761,147 | 8/1988 | Gauthier | 439/607 |
| 4,772,224 | 9/1988 | Talend | 439/607 |
| 4,820,174 | 4/1989 | Farrar et al. | 439/95 |
| 4,915,655 | 4/1990 | Tanaka | 439/676 |
| 4,960,392 | 10/1990 | Dickie | 439/620 |
| 4,992,060 | 2/1991 | Meyer | 439/620 |
| 4,995,834 | 2/1991 | Hasegawa | 439/620 |
| 5,022,870 | 6/1991 | Sakamoto et al. | 439/608 |
| 5,023,577 | 6/1991 | Drake | 333/182 |
| 5,150,086 | 9/1992 | Ito | 333/182 |
| 5,153,539 | 10/1992 | Hara et al. | 333/182 |
| 5,213,522 | 5/1993 | Kojima | 439/620 |
| 5,219,296 | 6/1993 | Nguyen | 439/95 |
| 5,219,305 | 6/1993 | Kawaguchi et al. | 439/620 |
| 5,224,878 | 7/1993 | Lurie et al. | 439/620 |
| 5,246,387 | 9/1993 | Liebich et al. | 439/620 |
| 5,257,950 | 11/1993 | Lenker et al. | 439/620 |
| 5,280,257 | 1/1994 | Cravens et al. | 333/182 |
| 5,282,759 | 2/1994 | Sakamoto et al. | 439/620 |
| 5,286,221 | 2/1994 | Fencl et al. | 439/607 |
| 5,304,964 | 4/1994 | DiMarco | 333/181 |
| 5,312,273 | 5/1994 | Andre et al. | 439/607 |

FOREIGN PATENT DOCUMENTS

| | | |
|---|---|---|
| 64-2273 | 6/1989 | Japan . |

*Primary Examiner*—Gary F. Paumen

*Attorney, Agent, or Firm*—Daniel J. Long; M. Richard Page

[57] ABSTRACT

Disclosed is a filtered modular jack assembly having an outer insulative housing with open front and end sides. A ferrite element with vertical conductive wires is positioned adjacent the rear end, and a elongated insulative insert is superimposed over the ferrite element. The insulative insert is fixed to the housing, and the conductive wire extend vertically from the ferrite element over the upper side of the insert to its terminal end and then bend downwardly and rearwardly to rest on the top surface of an interior medial wall in the housing. A method of assembling a jack with a noise filtering capability is also disclosed.

30 Claims, 6 Drawing Sheets

FILTERED MODULAR JACK ASSEMBLY AND METHOD OF USE

BACKGROUND OF INVENTION

1. Field of the Invention

The present invention relates to electrical connectors and more particularly to electrical connectors within which noise filter means are incorporated.

2. Brief Description of Prior Developments

In electronic appliances containing modular jacks, various types of filters are used to reduce or eliminate noise. Such filters may include a three terminal capacitor or a common mode choke coil. A disadvantage in the use of such filters is that they may complicate the production of the circuit board. A need, therefore, has been perceived for providing a simple means of filtering noise in modular jacks.

The use of an integral ferrite element for this purpose is proposed in Japanese Patent Publication 64-2273. This reference discloses a modular jack having a modular insert installed in a casing. The body of the insert is formed with ferrite, and on one side of the insert body insert holes are formed for introducing connecting lines to be connected to respective contact springs.

While the above mentioned reference would appear to simplify the apparatus used for noise filtering in modular jacks, a need for further increasing the compactness of such modular jacks with integral ferrite elements exists.

SUMMARY OF THE INVENTION

In the modular jack of the present invention, there is an outer insulative housing. An interior medial wall projects upwardly from the bottom wall of this housing. The housing has open front and rear ends and a ferrite element is positioned over part of the open rear end and against the interior medial wall. An elongated insulative insert is positioned over the top end of the ferrite element and extends into the interior of the housing. Conductive wires extend upwardly through bores in the ferrite element and through axially aligned bores in the insulative insert. These conductive wires extend laterally in grooves in the upper surface in the insulative insert and at the terminal end of the insulative insert bend downwardly and rearwardly to rest on the upper surface of the interior medial wall. On the opposed lateral sides of the interior medial wall there are upward extensions which engage latches on the lower base side of the insulative insert.

BRIEF DESCRIPTION OF THE DRAWINGS

The filtered modular jack assembly of the present invention is further described with reference to the accompanying drawings in which.

DETAILED DESCRIPTION OF THE PREFERRED EMBODIMENT

Figure 1:
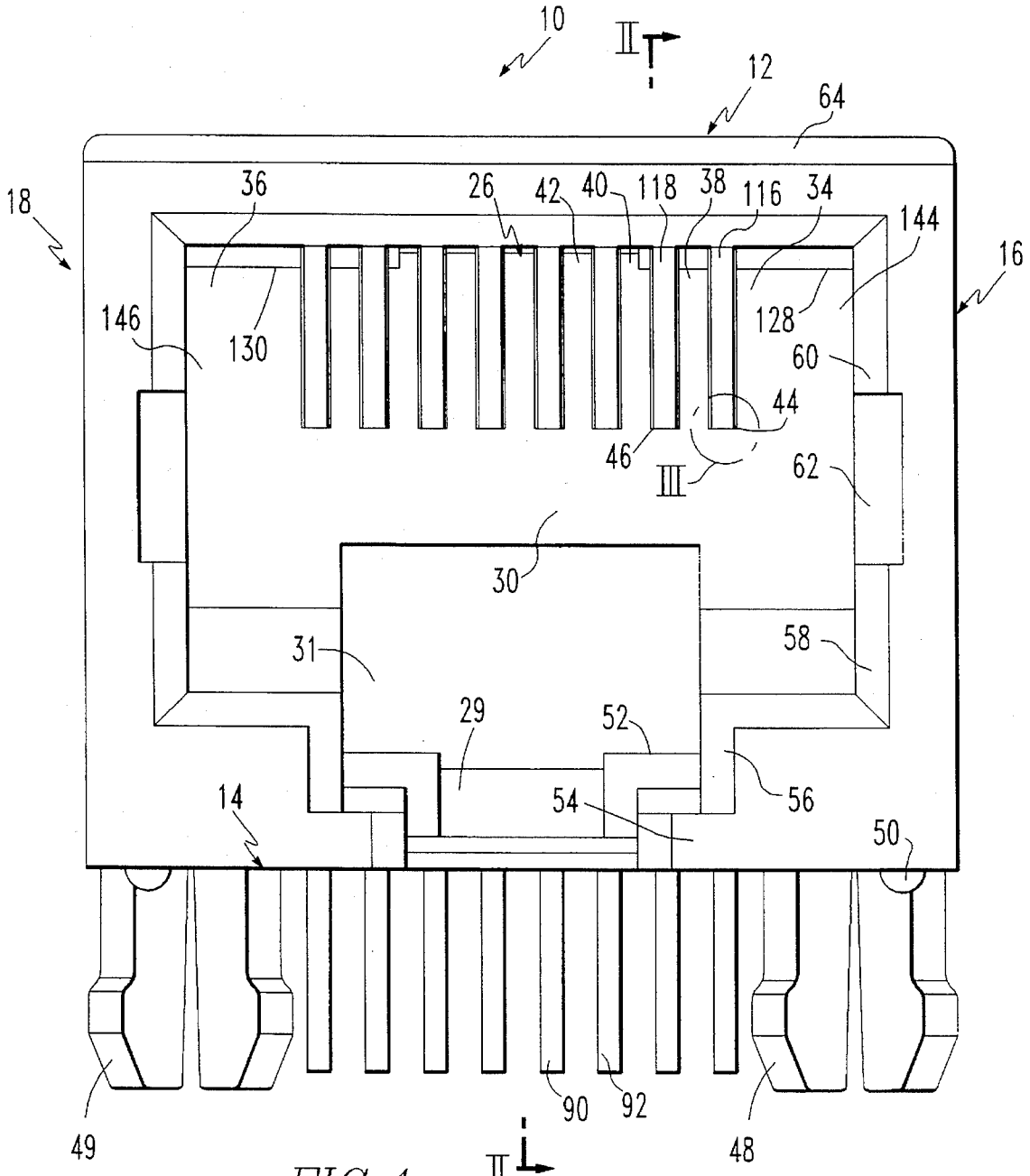
FIG. 1 is an end view of a preferred embodiment of the filtered modular jack assembly of the present invention.
Figure 3:
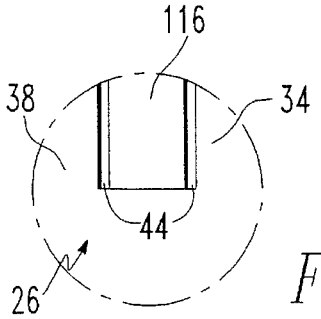
FIG. 3 is a detailed view of the area within circle III of FIG. 1.
Figure 2:
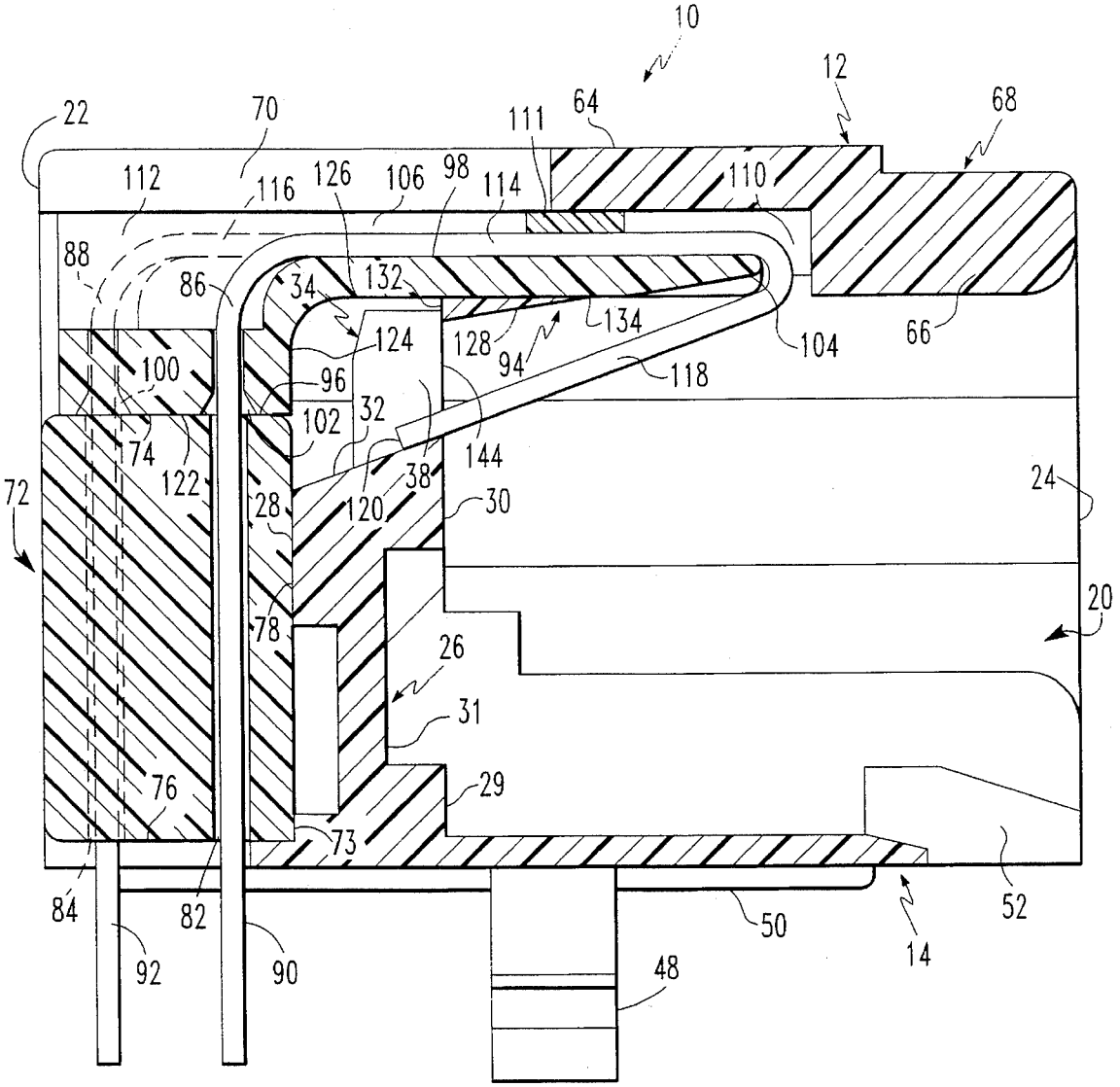
FIG. 2 is a cross sectional view taken through line II—II in FIG. 1.
Figure 4:
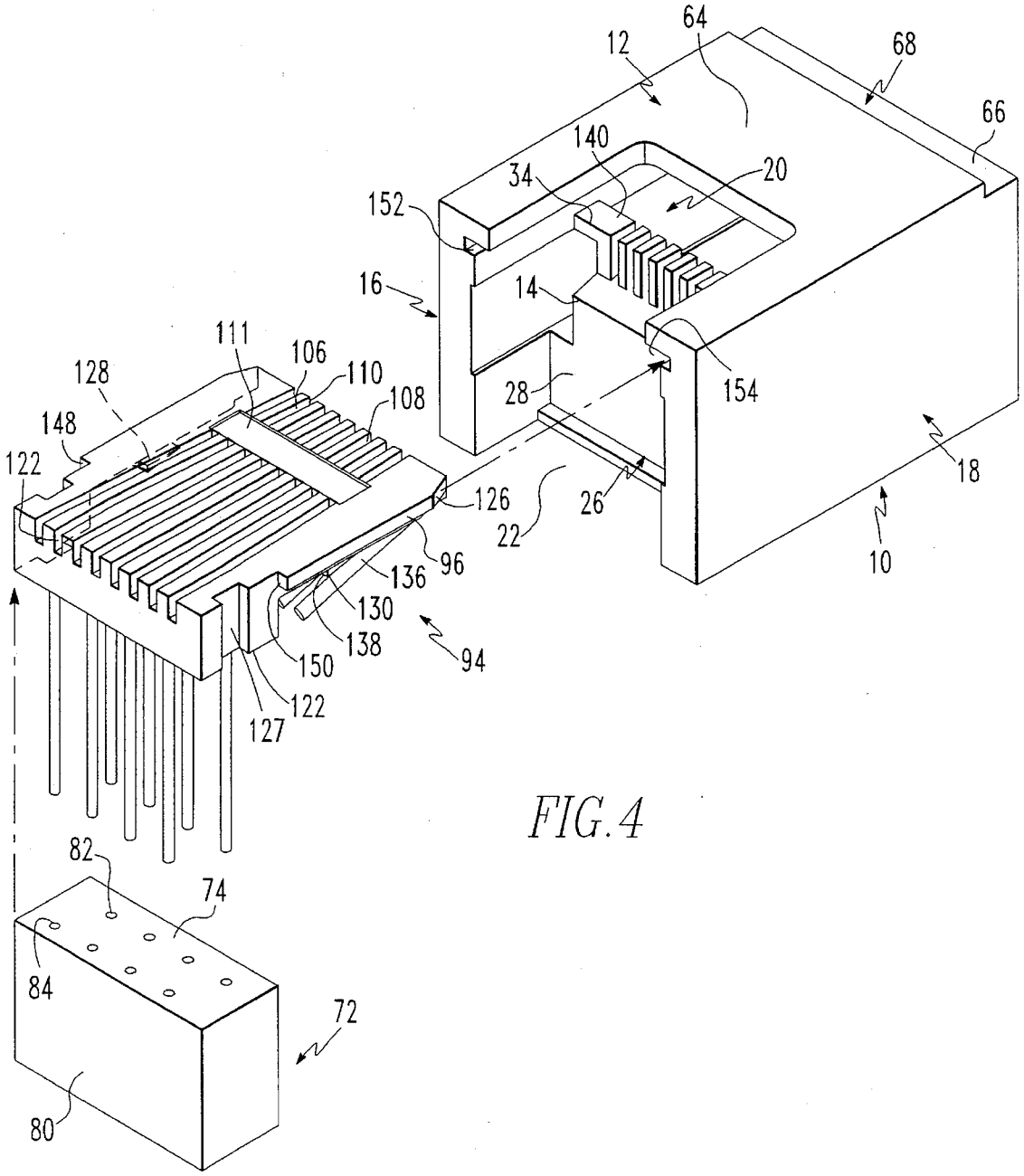
FIG. 4 is a disassembled perspective view of the filtered modular jack assembly shown in FIG. 1.
Figure 5:
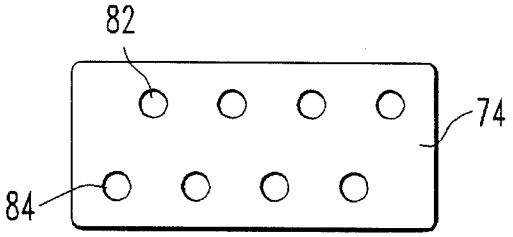
FIGS. 5, 6 and 7 are respectively top plan, end and side elevational views of the ferrite element included in FIG. 1.
Figure 6:
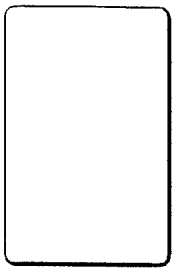
Figure 7:
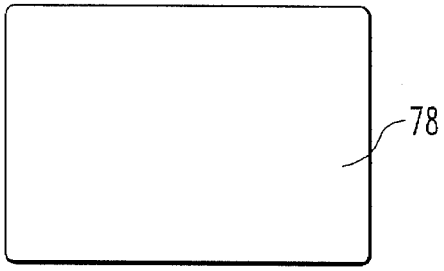
Figure 8:
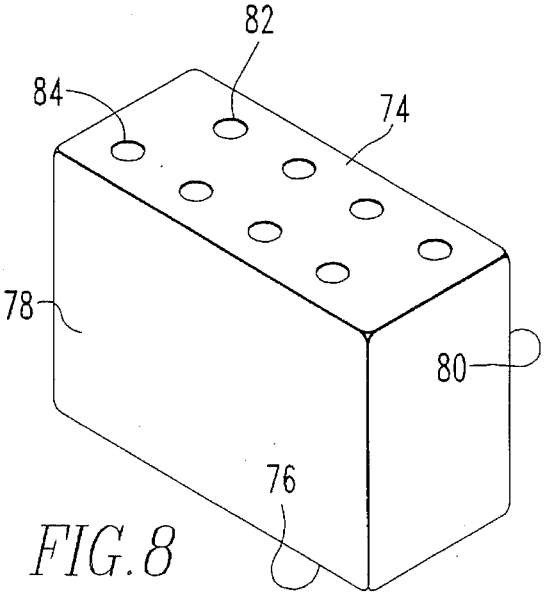
FIG. 8 is a perspective view of the ferrite element shown in FIGS. 4, 5 and 6.

Referring to the drawings, the outer insulative housing is shown generally at numeral 10. This housing includes a top wall 12, a bottom wall 14 and a pair of opposed lateral walls 16 and 18. The material from which the housing is constructed is a thermoplastic polymer having suitable insulative properties. Within these walls is an interior section 20 which has a rear open end 22 and a forward open end 24. Projecting upwardly from the bottom wall in this interior section there is a medial wall generally shown at numeral 26 which has a rear side 28 and a front side made up of a bottom front side 29, a top front side 30 and a recessed medial front side 31 and an inclined top side or surface 32 which slopes upwardly and forwardly from its rear side toward its front side. Adjacent to the lateral walls, the medial wall has lateral extensions 34 and 36 which serve as projections to retain other elements as will be hereafter explained. Interposed between these lateral extensions there are a plurality of wire separation extensions as at 38, 40 and 42 and between these wire separation extensions there are plurality of slots at 44 and 46.

Extending downwardly from the bottom wall there is a pin 48 and a stand off 50. In the bottom wall of the insulative housing there is also a front slot 52. The lateral wall 16 includes a lower shoulder 54, another shoulder 56, a lower main wall 58, an upper main wall 60 and a recessed wall 62 interposed between the lower and upper main wall. It will be seen that the lateral wall 18 has substantially identical features as lateral wall 16. The top wall 12 includes an upper bridge section 64, a lower bridge section 66, a front recess 68 and a rear recess 70.

A ferrite element shown generally at 72 abuts the rear side of the interior wall and is positioned over a portion of the open rear end of the insulative housing adjacent the bottom wall and is securely retained in position in part by means of being positioned against shoulder 73 which is part of the medial wall and which extends upwardly from the bottom wall. The ferrite element includes a top end 74, a bottom end 76, a front side 78, a rear side 80 and a plurality of vertical bores as at 82 and 84. Conductive wires as at 86 and 88 pass through these bores and extend downwardly to form leads as at 90 and 92. By "ferrite" what is meant is any of the group of ceramic ferromagnetic compounds of ferric oxide with other oxides including, without limitation, such compounds with spinel crystalline structure characterized by both high magnetic permeability and electrical resistivity and materials having similar magnetic and electrical characteristics which are used for noise reduction or elimination purposes.

An insulative insert shown generally at 94 includes a base side 96 and upper side 98 and vertical bores 100 and 102. The material from which the insulative insert is constructed is any thermoplastic polymer having suitable insulative properties. The insulative insert is "L" shaped and is positioned so that its base side abuts the top end of the ferrite element and the bores 100 and 102 are axially aligned respectively with bores 84 and 82 in the ferrite element. In the interior section of the housing the insert has a terminal end 104 and on its upper side there are a plurality of upper grooves as at 106 and 108 and at the terminal end there are plurality of end grooves as at 110. An ultrasonically welded section 111 retains the wires in position. The insulative insert is positioned on the rear opened end so that recesses as at 112 are formed therein. The conductive wires extend upwardly through bores 110 and 112 and bend to extend horizontally in the top grooves as in lateral sections 114 and 116. At the end of the grooves the wires bend downwardly to form a downward and rearward extension as at 118 extending toward the rear end of the insulative housing. At the terminal ends as at 120 of the conductive wires they rest on the top side of the medial wall. It will also be noted that the insulated insert is generally "L" shaped, and the base surface thereof is comprised of a lower base surface 122 which extends inwardly to a vertical step 124 which extends upwardly to an upper base surface 126. Those skilled in the art will also appreciate that vertical grooves as at 127 may also be employed on the insert to better secure it to the housing by snapping it into engagement with vertical ridges (not shown) on the housing.

Means are also provided for fixing the insulative insert to the housing. In the preferred embodiment illustrated, these means comprise a pair of triangularly cross sectional latches 128 and 130 which project downwardly from the upper base surface of the insulative insert. Latch 128 has a front end 132 and a rear end 134 and latch 130 has a front end 136 and a rear end 138. These clips increase in height from their front ends to their rear ends so that when the insulative insert is inserted into the interior of the housing the latches 128 and 130 pass over the tops 140, respectively, of the lateral extensions 34 and 36 of the medial wall. When the insert has been completely inserted in the interior of the housing their rear ends 134 and 138 will bear respectively against the front sides 144 and 146 of the lateral extensions 34 and 36 to fix the insulative insert to the housing. To further assist in fixing the insulative insert to the housing, there are lateral ridges 148 and 150 which engage respectively grooves 152 and 154 in the lateral walls.

Figure 9:
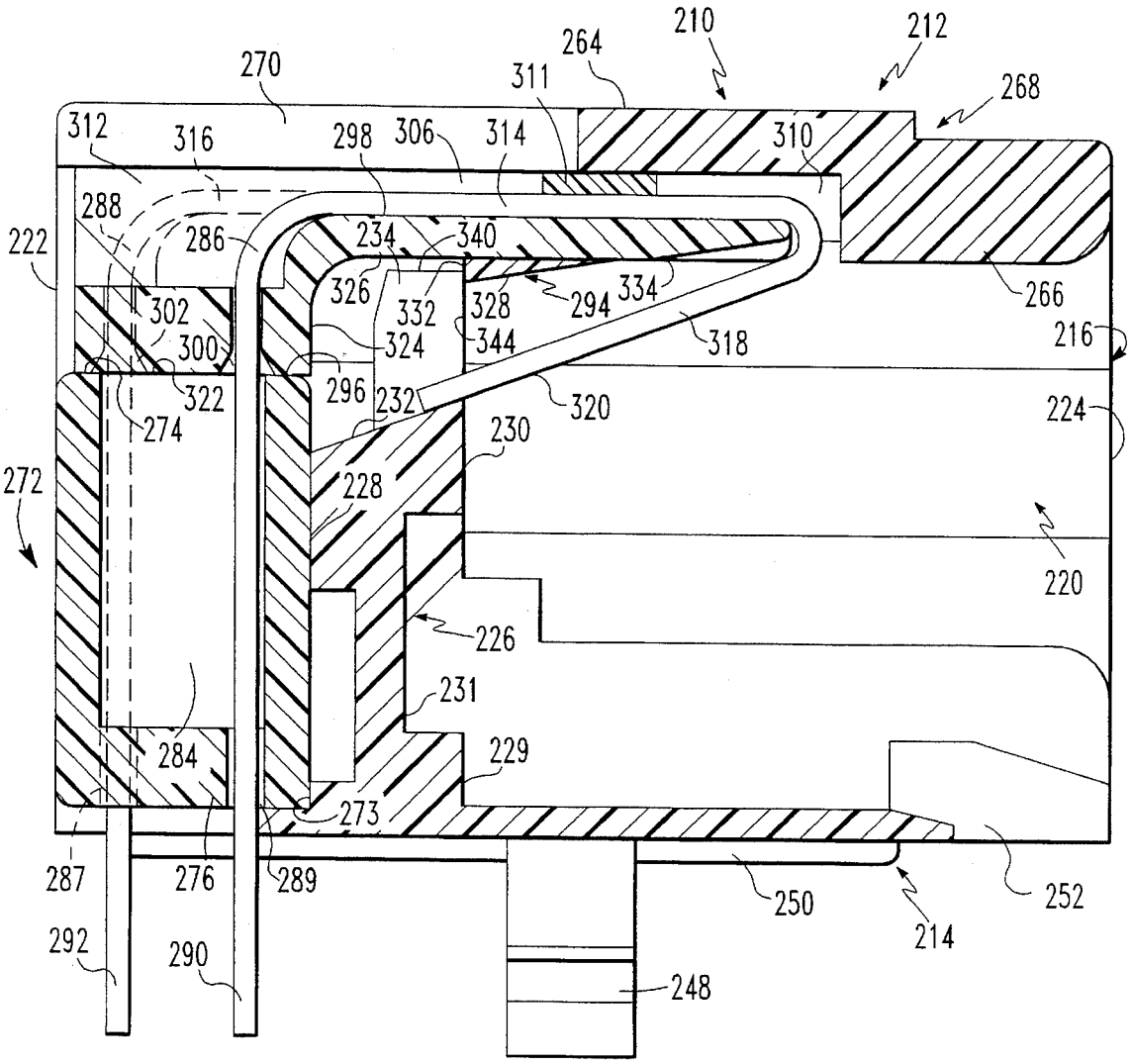
FIG. 9 is a cross sectional view similar to FIG. 2 of an alternate embodiment of the filtered modular jack assembly of the present invention.
Figure 10:
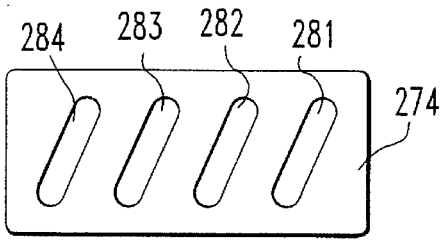
FIG. 10, 11 and 12 are respectively top plan, end and side elevational views of the ferrite element included in FIG. 8.
Figure 11:
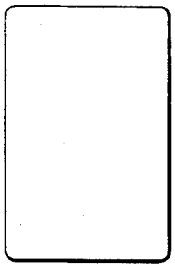
Figure 12:
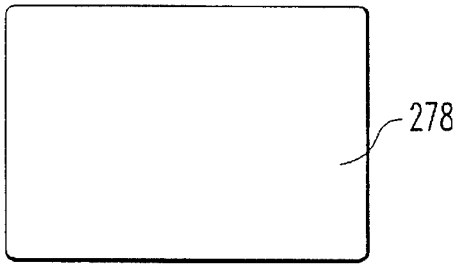
Figure 13:
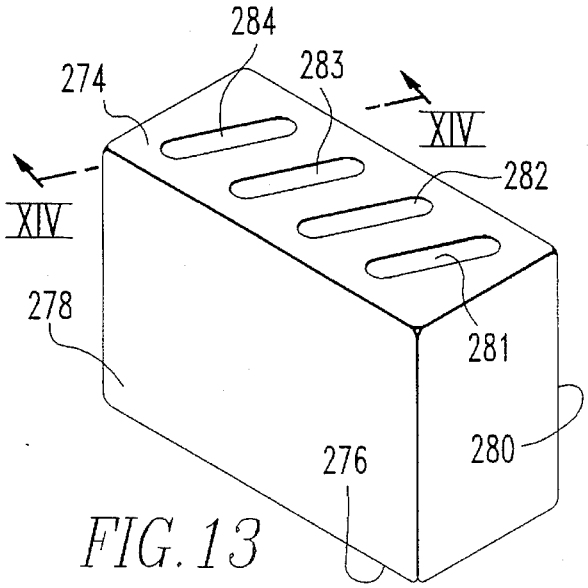
FIG. 13 is a perspective view of the ferrite element shown in FIGS. 9, 10 and 11.
Figure 14:
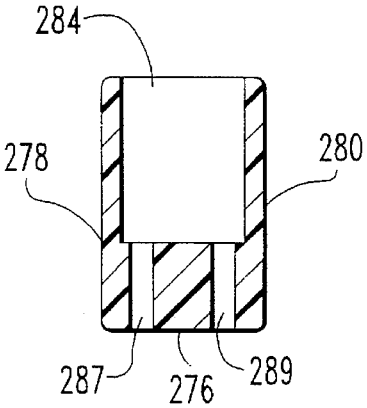
FIG. 14 is a cross sectional view taken through XIV—XIV in FIG. 13.

Another embodiment is shown in FIGS. 9–14. Referring to these figures, the outer insulative housing is shown generally at numeral 210. This housing includes a top wall 212, a bottom wall 214 and a lateral walls 216 and an opposed lateral wall (not shown). Within these walls is an interior section 220 which has a rear open end 222 and a forward open end 224. Projecting upwardly from the bottom wall in this interior section there is a medial wall 226 which has a rear side 228 and a front side 230 and an inclined top side 232 which slopes upwardly and forwardly from its rear side toward its front side. Adjacent to the lateral walls, the medial wall has lateral extensions as at 234. Interposed between these lateral extensions there are as in the assembly of the first embodiment, a plurality of wire separation extensions and between these wire separation extensions there are a plurality of slots.

Extending downwardly from the bottom wall there is a pin 248 and a stand off 250. In the bottom wall of the insulative housing there is also a front slot 252. Similarly to the first embodiment, the lateral wall 216 includes a lower shoulder, another shoulder, a lower main wall, an upper main wall and a recessed wall interposed between the lower and upper main wall. The opposed lateral wall has substantially identical features as lateral wall 216. The top wall 212 includes an upper bridge section 264, a lower bridge section 266, a front recess 268 and a rear recess 270.

A ferrite element shown generally at 272 is positioned against shoulder 273 in the bottom wall to abut the rear side of the interior wall and is positioned over a portion of the open rear end of the insulative housing adjacent the bottom wall. The ferrite element includes a top end 274, a bottom end 276, a front side 278, a rear side 280 and a plurality of elongated vertical recesses as at 281,282, 283 and 284. Conductive wires as at 286 and 288 pass through these bores and extend downwardly through connecting vertical bores as at 287 and 289 to form leads as at 290 and 292. Those skilled in the art will appreciate that the positioning of both wires in the recess 284 will result in the reduction of common mode electromagnetic interference (EMI).

An insulative insert shown generally at 294 includes a base side 296 and upper side 298 and vertical bores 300 and 302. The insulative insert is "L" shaped and is positioned so that its base side abuts the top end of the ferrite element and the bores 300 and 302 are axially aligned respectively with recess 284 in the ferrite element. In the interior section of the housing the insert has a terminal end 304 and on its upper side there are a plurality of upper grooves as at 306 and at the terminal end there are a plurality of end grooves as at 310. An ultrasonic weld section 311 holds the wires to the groove. The insulative insert is positioned on the rear opened end so that a slot 312 is formed therein. The conductive wires extend upwardly through bores 300 and 302 and bend to extend horizontally in the top grooves as in lateral sections 314 and 316. At the end grooves they bend downwardly to form a downward and rearward extension as at 318 extending toward the rear end of the insulative housing. At the terminal ends 320 of the conductive wires they rest on the top side of the medial wall. It will also be noted that the insulated insert is generally "L" shaped, and the base surface thereof is comprised of a lower base surface 322 which extends inwardly to a vertical step 324 which extends upwardly to an upper base surface 326.

Means we also provided for fixing the insulative insert to the housing. In the preferred embodiment illustrated these means comprise a pair of triangularly cross sectional latch as at 328 which project downwardly from the upper base surface of the insulative insert. Latch 328 has a front end 332 and a rear end 334. These latches increase in height from their front ends to their rear ends so that when the insulative insert is inserted into the interior of the housing the latches as at 328 pass over the tops as at 340 of the lateral extensions as at 334 of the medial wall. When the insert has been completely inserted in the interior of the housing their rear ends as at 334 bear against the front sides as at 344 of the lateral extensions as at 234 to fix the insulative insert to the housing.

To further assist in fixing the insulative insert to the housing, there are lateral ridges (not shown) which engage respectively grooves (not shown) in the lateral walls which are substantially the same as were illustrated in the first embodiment.

Those skilled in the art will appreciate that other equivalent arrangements for fixing the insulative insert to the housing would be possible. As a non-limiting example, a variety of types of interior retaining projections could project from the bottom wall of the housing adjacent the side wall to engage the clips on the insulative insert.

Those skilled in the art will also appreciate that a method for assembling a modular jack having a noise filtering capability has also been described. In particular, this method comprises the steps of: (a) positioning a ferrite element having top and bottom ends and front and rear sides adjacent the rear end of the outer insulative housing; (b) positioning an elongated insulative insert having base and upper sides and rear and terminal ends so that its base side is superimposed over the upper end of the ferrite element and its upper end is adjacent the top side of the insulative housing such that its terminal end extends into the interior section of the insulative housing; (c) providing conductive means extending vertically from the bottom end to the top end of the ferrite element and then from the base side to the upper side of the insulative insert and then generally horizontally to the terminal end of the insulative insert and then downwardly and rearwardly toward the rear end of the insulative housing; and (d) fixing the insulative insert to the insulative housing.

It will be appreciated that a means has been described for providing a modular jack with an integral noise filtering element.

It will also be appreciated that a means has been described for increasing the compactness of such filtered modular jacks with integral ferrite elements.

Although the invention has been described with a certain degree of particularity, it will be understood that the invention has been made only as an example, and that the scope of the invention is defined by the following claims.

What is claimed is:

1. A filtered modular jack assembly comprising:

(a) an outer insulative housing having top and bottom walls and opposed lateral walls all defining an interior section and said housing also having front and rear open ends;

(b) a ferrite element having top and bottom ends and being positioned adjacent the rear end of the outer insulative housing;

(c) an insulative insert having base and upper sides and rear and terminal ends and being positioned so that its base side is superimposed over the upper end of the ferrite element and its upper end is adjacent a top side of the insulative housing such that its terminal end extends into the interior section of the insulative housing;

(d) conductive means extending vertically from the bottom end to the top end of the ferrite element and then from the base side to the upper side of the insulative insert and then generally horizontally to the terminal end of the insulative insert and then downwardly and rearwardly toward the rear end of the insulative housing; and (e) means for fixing the insulative insert to the insulative housing.

2. The filtered modular jack of claim 1 wherein the conductive means extends downwardly below the bottom end of the ferrite element.

3. The filtered modular jack assembly of claim 2 wherein there are first and second generally parallel conductive means which extend vertically from the bottom end to the top end of the ferrite element and then from the base side to the upper side of the insulative insert and then generally horizontally to the terminal end of the insulative insert and then downwardly and rearwardly toward the rear end of the insulative housing.

4. The modular jack assembly of claim 3 wherein there are generally parallel first and second vertical bores in the ferrite element extending from the bottom end to the top end thereof and there are first and second vertical bores in the insulative insert extending from the base to the upper side thereof and which are axially aligned respectively with the first and second vertical bores in the ferrite elements and the first conductive means is positioned inside said aligned first vertical bores and the second conductive means is positioned inside said second aligned vertical bores.

5. The modular jack assembly of claim 3 wherein there are a plurality of additional conductive means which extend vertically from the base side.

6. The modular jack assembly of claim 5 wherein these are a plurality of additional generally parallel vertical bores in the ferrite element extending from the bottom end to the top end thereof and there are a plurality of additional generally vertical bores in the insulative insert extending from the base side to the top side thereof and each of said vertical bores in the ferrite element is axially aligned with one of said vertical bores in the insulative insert and there is a said conductive means positioned in each of said plurality of aligned bores.

7. The modular jack assembly of claim 4 wherein there is a first groove in the upper side of the insulative insert extending from the first vertical bore to the terminal end of the insulative insert and there is a second groove in the upper side of the insulative insert extending from the second vertical bore to the terminal end of the insulative insert and the first conductive means extends in said first groove and the second conductive means extends in said second groove.

8. The modular jack assembly of claim 6 wherein there are a plurality of grooves, each of said grooves extends from one of said vertical bores in the insulative insert to the terminal end of the insulative insert and one of said conductive means is positioned in each of said grooves.

9. The filtered modular jack assembly of claim 1 wherein an interior medial wall extends upwardly from the bottom wall of the insulative housing and said medial wall has front and rear sides and a top surface and the terminal ends of the conductive means rests on said top surface.

10. The filtered modular jack assembly of claim 9 wherein the top side of the interior medial wall slopes upwardly and forwardly from its rear side.

11. The filtered modular jack of claim 1 wherein at least one latch extends from the insulative insert to engage the insulative housing.

12. The filtered modular jack assembly of claim 11 wherein at least one interior insert retaining projection extends upwardly from the bottom side of the insulative housing to be engaged by the latch extending from the insulative insert.

13. The filtered modular jack assembly of claim 9 wherein there are lateral extensions of the interior medial wall adjacent the opposed lateral walls of the housing and there latches which project downwardly from the base surface of the insulative insert and said latches engage said lateral extensions to fix the insulative insert to the insulative housing.

14. The filtered modular jack assembly of claim 13 wherein the latches comprise triangularly cross sectional projections having rear and front ends and a height and which increase in height from their front to rear ends.

15. The filtered modular jack assembly of claim 14 wherein the base side of the insulative insert is comprised of a lower base side which extends inwardly to a vertical step which extends upwardly to an upper base surface which extends inwardly to the terminal end.

16. The filtered modular jack assembly of claim 15 wherein the latches project downwardly from the upper base surface of the insulative insert.

17. The filtered modular jack assembly of claim 12 wherein a first and second interior retaining projections extending from the lower wall of the housing are positioned adjacent to each of the lateral walls of the insulative housing and there are opposed first and second lateral edges on the insulative insert and first and second latches extend downwardly from the insulative insert respectively adjacent the first and second lateral inserts to engage, respectively the first and second interior retaining projections.

18. The filtered modular jack assembly of claim 10 wherein there is a first and a second said conductive means and a wire separation projection extends upwardly from the top surface of said interior medial wall to separate said first and second conductive means.

19. The filtered modular jack assembly of claim 14 wherein there is an additional plurality of conductive means which rest the top surface and between each of said conductive means a wire separation projection extends upwardly from the top surface to separate each of said conductive means from adjacent said conductive means.

20. The modular jack assembly of claim 3 wherein there is a central recess extending downwardly in the ferrite element and the first and second conductive means are both contained within said recess.

21. The modular jack assembly of claim 20 wherein first and second bores extend downwardly from the recess and the first and second conductive means respectively extend separately downwardly in said first and second bores.

22. The modular jack assembly of claim 1 wherein the bottom end of the ferrite element is positioned against a shoulder extending upwardly from the bottom wall of the insulative housing.

23. The modular assembly of claim 22 wherein the ferrite element is securely retained in position between the ferrite element and the shoulder.

24. A method of assembling in a modular jack having an outer insulative top and bottom walls and opposed lateral walls all defining an interior section and said housing also having front and rear open ends, comprising the steps of:

(a) positioning a ferrite element having top and bottom ends and front and rear sides adjacent the rear end of the outer insulative housing;

(b) positioning an elongated insulative insert having base and upper sides and rear and terminal ends so that its base side is superimposed over the upper end of the ferrite element and its upper end is adjacent the top side of the insulative housing such that its terminal end extends into the interior section of the insulative housing;

(c) providing conductive means extending vertically from the bottom end to the top end of the ferrite element and then from the base side to the upper side of the insulative insert and then generally horizontally to the terminal end of the insulative insert and then downwardly and rearwardly toward the rear end of the insulative housing; and (d) fixing the insulative insert to the insulative housing.

25. The method of claim 24 wherein an interior medial wall extends upwardly from the bottom wall of the insulative housing and said medial wall has front and rear side and a top surface and the terminal ends of the conductive means rests on said top surface.

26. The method of claim 25 wherein there are lateral extensions of the interior medial wall adjacent the opposed lateral walls of the housing and there latches which project downwardly from the base surface of the insulative insert and said latches engage said lateral extensions to fix the insulative insert to the insulative housing.

27. The method of claim 26 wherein the latches comprise triangularly cross sectional projections having rear and front ends and a height and which increase in height from their rear to front ends.

28. The method of claim 27 wherein the base side of the insulative insert is comprised of a lower base side which extends inwardly to a vertical step which extends upwardly to an upper base surface which extends inwardly to the terminal end.

29. The method of claim 28 wherein the latches project downwardly from the upper base surface.

30. An electrical connector comprising:

(a) an outer insulative housing having top and bottom walls and opposed lateral walls all defining an interior section and said housing also having front and rear open ends;

(b) a ferrite element having top and bottom ends and being positioned adjacent the rear end of the outer insulative housing;

(c) an insulative insert having base and upper sides and rear and terminal ends and being positioned so that its base side is superimposed over the upper end of the ferrite element and its upper end is adjacent the top side of the insulative housing such that its terminal end extends into the interior section of the insulative housing;

(d) conductive means extending vertically from the bottom end to the top end of the ferrite element and then from the base side to the upper side of the insulative insert and then generally horizontally to the terminal end of the insulative insert and then downwardly and rearwardly toward the rear end of the insulative housing; and (e) means for fixing the insulative insert to the insulative housing.

* * * * *